US005590639A

United States Patent [19]

Kempin

[11] Patent Number: 5,590,639

[45] Date of Patent: Jan. 7, 1997

[54] MASONARY CUTTING TOOL AND METHOD

[76] Inventor: Ronald Kempin, 3 Rodgers Place, Bullcreek Perth, Australia

[21] Appl. No.: 117,165

[22] PCT Filed: Jul. 24, 1991

[86] PCT No.: PCT/AU91/00328

§ 371 Date: Sep. 17, 1993

§ 102(e) Date: Sep. 17, 1993

[87] PCT Pub. No.: WO92/02345

PCT Pub. Date: Feb. 20, 1992

[30] Foreign Application Priority Data

Jul. 25, 1990 [AU] Australia ..... PK1531

[51] Int. Cl.[6] ..... B28D 1/26

[52] U.S. Cl. ..... 125/41; 30/128

[58] Field of Search ..... 125/41; 30/168

[56] References Cited

U.S. PATENT DOCUMENTS 2,199,380 5/1940 Walraven ..... 30/168

2,630,627 3/1953 Beck ..... 30/168

FOREIGN PATENT DOCUMENTS 481661 1/1917 France ..... 125/41

*Primary Examiner*—Bruce M. Kisliuk
*Assistant Examiner*—George Nguyen
*Attorney, Agent, or Firm*—William A. Drucker

[57] ABSTRACT

The disclosure is directed to a method of masonary cutting and to the structure of a novel tool. The tool has twin outwardly splayed and flared chisel like blades which join the handle at a recess groove for waste ejection. The blades are beveled only on their upper edges and are driven forward by hammering on the remove handle end. The method comprises attacking a flat masonary surface at an angle greater than 5 degrees (preferably at 13 degrees) with twin divergent cutting edges beveled only on the upper surfaces and having a flat lower surface. Material is imploded between the blades and ejected at the recess groove without dust formation.

2 Claims, 1 Drawing Sheet

MASONARY CUTTING TOOL AND METHOD

CROSS REFERENCE TO RELATED APPLICATIONS

This application is based upon a filing in Australia No. PK 1531 of Jul. 25, 1990. This application is a 371 of PCT/AU91/00328 of Jul. 21, 1991.

This disclosure contains no rights to any invention made under Federally sponsored research and development.

BACKGROUND OF THE INVENTION

1. Field of the Invention

The invention relates to a method and tool for cutting grooves and channels in brickwork, masonary and masonary rendering such as stucco. The tool is a kind of single bevel twin blade chisel for dust-free chasing of brick and masonary material by cutting groves, recesses and penetrations into structures and by removing material by laminar separation. Such chasing is conventional to conceal electric cables and pipework below a structural surface.

2. Description of the Prior Art

Known methods of masonary chasing include both drilling and sawing which both create occupational health hazards from the dust evolved which may be inspired and require protective equipment. Silicosis is a recognized occupational lung disease of brick and stone workers. Although other cutting tools including chisels are known to the masonary prior art, these require a method of multiple cuts in serial operations and may shatter or deface the area near the groove.

Recognized prior patents include: U.S. Pat. No. 2,199,380 of May 7, 1940 by WALRAVEN and U.S. Pat. No. 2,630,627 of Mar. 10, 1953 by BECK for panel cutting tools and French Patent 481,661 of Jan. 17, 1917 by FOUQUET for chisels. None of these patents produces a dust-free groove in a single operation. Other prior art includes EP 131,688.

SUMMARY OF THE INVENTION

The invention discloses an article of manufacture which is a cutting tool comprising at least two coplanar single-beveled cutting edges diverging from a central mounting which include at their V junction a recess at a handle mounting which is made in steel. The tool generates an implosion between twin blades at an operating angle between 5° and 90° to the surface being cut and provides laminar separation of tiles from mortar as well as forming grooves in brick, without generation of dust.

In the method of the invention the divergent single bevel cutting edges are driven forward along a groove in brick (for example) by hammering on the remote handle end. The step of masonary imploding between and ahead of the cutters avoids dust generation.

DESCRIPTION OF THE PREFERRED EMBODIMENTS

The following statement is a full description of this invention, including the preferred embodiments and the best method of performing it known to the inventor.

The invention is directed to a tool and to a method of dust-free chasing of brick structures. A chisel type tool is specially adapted for cutting groves, recesses and penetrations in masonary, such as brick structures with little or no dust production. Avoidance of dust avoids occupational health hazards.

The invention includes a method of cutting which optimizes the removal of materials by laminar separation.

In the method of the invention the single-bevel chisel tip enters and is driven through masonary by percussion applied to the handle remote from the cutting edge, which causes implosion of debris between the convergent cutting edges at a central venting groove or recess where the blades join the handle. The recess is coaxial with the elongated handle. The forwardly outwardly diverging splayed cutting edges joined at the recess provide a novel attack upon friable masonary in a single cutting operation. There is no need to drill or saw to avoid shattering or defacement of the area surrounding the work area. Percussion may be applied by hammering the tool handle by hand, electric, hydraulic or air operated hammers.

Depth and straightness of the grooves or recesses and cleanliness of the cut are achieved by addressing the chisel at the angle of attack according to the preferred configuration, now to be described.

Figure 1:
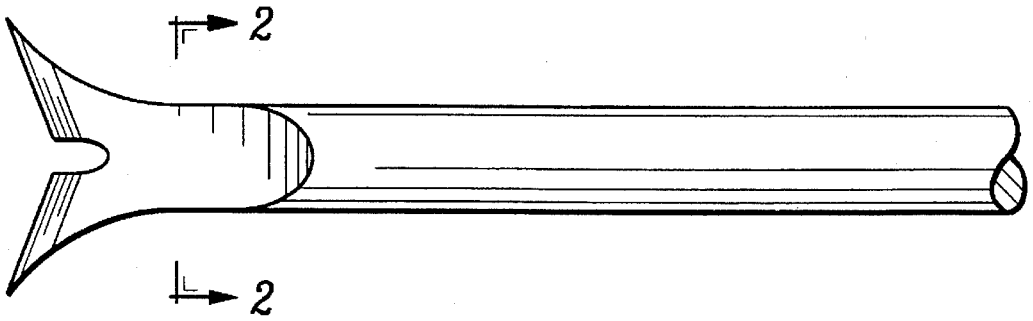
FIG. 1 is a plan view of the masonary cutting tool showing twin forwardly divergent single bevel cutting edges mounted at one end of an elongated steel handle. Where the edges approach each other in a V, a U-shaped recess is formed centrally in the handle.

As seen in FIG. 1, the splayed twin cutting blades are preferably flared along a 150 mm radius. The width of the cut is determined by the separation of the distal cutting tips which is preferably between 15 and 40 mm. The recess between the cutters, coaxial with the elongated handle extends back from the single beveled cutting edges. The proximal closed end of the recess may be U-shape. The flared edges of the blades may extend forward about the depth of the recess.

Figure 2:
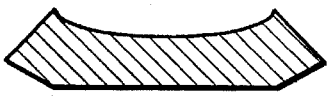
FIG. 2 is a cross sectional and elevational view of the handle beyond the recess which shows the concave structure of the upper handle which may also be V-cut along the upper surface.

As seen in FIG. 2, an end elevational cross section of the preferred handle design, the lower handle surface is flat and the upper surface is V-cut or concave, whereas the edges are beveled at the flared radius proximal to the recess, both upward on the bottom and inward on the top.

Figure 3:
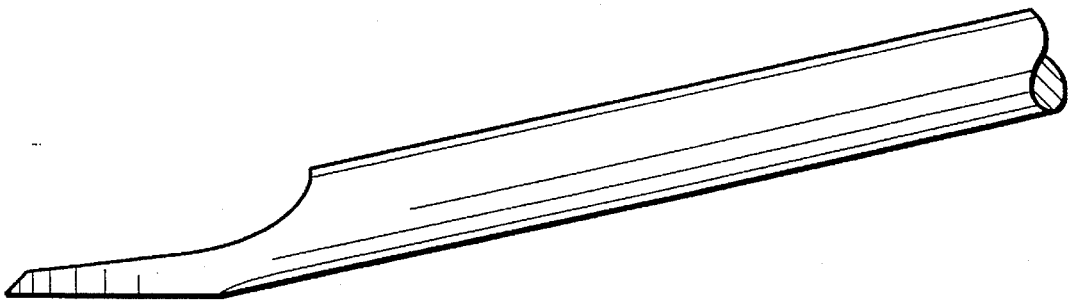
FIG. 3 is a side elevation of the tool showing the flat single-bevel lower surface of cutters as they engage the work, the upward single cutter bevel, and the curved upper radial surface of the cutters as they merge into the handle.

As seen in FIG. 3, a side elevational view of the tool, the main handle body inclines upward at about 13 degrees from the flat lower blade surface. The flat area may extend back from the cutting edge about 50 mm. The cutting edges include a single bevel of about 45 degrees.

The preferred material of manufacture of the tool is heat treated tool steel.

In the method of cutting according to the invention twin opposing, angled single beveled blades are driven at an angle of attack on the work surface as low as 5 degrees (preferable at 13 degrees). When driven into mortar under tile the distal blade tips of the single bevel twin blades engage the work at the first impact and hold the tool down firmly to the surface. On second impact there is implosion at the mortar bed below the tile which cleanly ejects the tile from the masonary. This method provides fast and safe laminar separation of tile, leaving a smooth regular undersurface on the tile and masonary.

A groove is cut in a single operation. Twin opposed single bevel flat bottom angled blades form shock waves in the work material which waves cross each other in front of the tool. This causes an implosion in a confined area between the blades which is safe and causes no structural damage.

In the prior art, a hand or machine driven cold chisel having a double bevel single blade is driven at an angle between 60 and 90 degrees. Below 60 degrees the point will glance off. At 60 degrees there is an explosion of work material in the radius around the impact point, leaving a rough surface. The prior art lacks twin V-divergent flat bevel cutting edges joined to the handle at a recess for material ejection and in the prior art there is no implosion of cuttings.

What is claimed is:

1. A method of cutting masonary comprising the steps of:

(a) attacking a flat masonary surface at an angle greater than 5 degrees with a single bevel twin divergeut blade tool having twin leading cutting edges distally flared and splayed more than 15 milimeters with a recess at the junction of said recess;

(b) driving the twin edges into the masonary by percussion of a handle mounting said blades;

(c) imploding the masonary material of said surface between said blades and through said recess to eject said imploded material from between said blades without damage to surrounding masonary and substantially without dust formation.

2. An article of manufacture, as a tool for cutting masonary, comprising:

a handle attached to and merging into a tapered tool end having a curved upper concave surface;

a flat distal lower surface angled to the extended longitudinal axis of said handle;

a bevel between said curved upper surface and said flat lower surface to form twin leading cutting edges, having a single upward bevel;

said cutting edges being distally flared and splayed outward in a V shape with a distal width greater than 15 mm;

a recess at the junction of the twin cutting edges.

* * * * *